US005383260A

United States Patent [19]

Deschenes et al.

[11] Patent Number: 5,383,260

[45] Date of Patent: Jan. 24, 1995

[54] FASTENER CLIP INCLUDING ONE OR MORE FASTENERS ADAPTED FOR ATTACHING BUTTONS TO A GARMENT OR LIKE MATERIAL

[75] Inventors: Charles L. Deschenes, North Attleboro; Terence J. Jones, Bolton, both of Mass.; William J. Cooper, Woonsocket, R.I.

[73] Assignee: Avery Dennison Corporation, Pasadena, Calif.

[21] Appl. No.: 989,201

[22] Filed: Dec. 11, 1992

[51] Int. Cl.[6] ..... A44B 9/02

[52] U.S. Cl. ..... 24/711; 24/90 R; 24/710.5; 24/72.7

[58] Field of Search ..... 24/711, 72–77, 24/89, 90 R, 90 B, 90 C, 90 TA, 90.5, 94, 456, 710.5, 710.8, 711.4

[56] References Cited

U.S. PATENT DOCUMENTS

| | | | |
|---|---|---|---|
| 2,935,434 | 5/1960 | Dawson | 24/710.5 X |
| 3,399,432 | 9/1968 | Merser . | |
| 3,494,004 | 2/1970 | Bone . | |
| 3,518,729 | 7/1970 | Merser . | |
| 3,815,798 | 6/1974 | Lavitch et al. . | |
| 3,893,612 | 7/1975 | Bone . | |
| 3,900,925 | 8/1975 | La Torraca | 24/90 R |
| 4,229,930 | 10/1980 | Ostermaier | 24/72.7 X |
| 4,281,782 | 8/1981 | Marsh et al. . | |
| 4,296,698 | 10/1981 | Davidson et al. . | |
| 4,316,562 | 2/1982 | Davidson et al. . | |
| 4,361,101 | 11/1982 | Marsh et al. . | |
| 4,456,123 | 6/1984 | Russell | 24/72.7 X |
| 4,533,076 | 8/1985 | Bourque | 227/67 |
| 4,877,172 | 10/1989 | Franklin et al. . | |

FOREIGN PATENT DOCUMENTS

| | | | |
|---|---|---|---|
| 2102676 | 8/1972 | Germany | 24/90 R |
| 1401751 | 7/1975 | United Kingdom | 24/90 R |

*Primary Examiner*—Laurie K. Cranmer
*Attorney, Agent, or Firm*—Kriegsman & Kriegsman

[57] ABSTRACT

A fastener clip having a plurality of fasteners for use in attaching a button to a garment or a piece of fabric. In a preferred embodiment, the fastener clip comprises a plurality of fasteners, each fastener being a flexible U-shaped filament having a foot at each end. The filament portion of the fastener is preferably rectangular in cross-section and has a non-uniform thickness, i.e., being thinner at the ends and thicker in the arcuate region, to maximize the strength of the fastener. The feet are appropriately dimensioned so that they may be inserted into a desired garment through a pair of button holes of conventional size and thereafter be retained by the underside of the garment. Each foot has rounded ends, a flat top surface and a compact size to minimize irritation with a person's skin. The fastener clip also comprises a pair of runner bars, each fastener being connected to the pair of runner bars by a pair of severable connector posts. The connector posts are attached to the outer sides of the fastener feet, as opposed to the bottoms thereof, so that, when they are severed, they will not create burrs in areas where they are likely to come into contact with a person's skin.

20 Claims, 10 Drawing Sheets

FASTENER CLIP INCLUDING ONE OR MORE FASTENERS ADAPTED FOR ATTACHING BUTTONS TO A GARMENT OR LIKE MATERIAL

The present invention relates to a new and novel fastener clip comprising one or more fasteners particularly well-suited for use in coupling or recoupling buttons or the like to a garment or similar material.

The conventional method of attaching buttons to garments or fabrics, either by machine or by hard, is with thread. The button is held in place and a needle containing thread is inserted through each of two, three or more holes in the button and into the material several times until sufficient strands of thread exist to securely hold the button to the material. The thread must then be tied or otherwise fastened so that it will not unravel. In some instances, where it is desired to elevate the button from the material, a pedestal effect is achieved by laterally wrapping the strands with additional thread. The disadvantages to this method of securing buttons to fabric or garments are several. First of all, it is a slow and tedious job and the button can soon become detached if only one of the threads is severed or if the ends of the thread are not secured properly.

In the commonly assigned U.S. Pat. Nos. 3,399,432, 3,470,834, and 3,494,004, all of which are incorporated herein by reference, there is described a plastic fastener which may be used instead of thread to attach a button to an article of clothing. The fastener typically comprises a flexible filament having a head at one end and a transverse bar at the opposite end. A plurality of such fasteners are typically manufactured as part of a clip in which the fasteners are interconnected in a row to a stringer or runner bar connected to the transverse bars of the fasteners by corresponding necks or connector posts. To sever an individual fastener from the fastener clip and to attach the severed fastener to a desired article (e.g., through a button hole and into an article of clothing), a fastener attaching device is typically used. Such a device typically comprises a casing, a needle projecting from the casing, the needle and the casing having longitudinal bores in alignment with each other, a plunger slidable back and forth within said bores, a handle telescoping over the rear of the casing for sliding said plunger within said bores, and means for feeding fasteners into the device successively with the transverse bars in alignment with said bores ahead of the plunger so that they may be projected through the needle by reciprocating the plunger. Typically, the rear end of the needle is shaped to define a knife edge so that insertion of the transverse bar into the longitudinal bore of the needle using the plunger causes the knife edge of the needle to sever the connector post connecting the fastener to the remainder of the fastener clip.

While the above-described fasteners have been found to be generally satisfactory for attaching buttons to certain articles of clothing, they have not found universal application for the following reasons: First, when placed in direct contact with a person's skin, the transverse bar of the fastener has a tendency to be irritating. This is in part because the above-described severing of the connector post often leaves a burr on the bottom of the transverse bar and is in part because of the somewhat sharp ends and large size of the transverse bar. Second, the fasteners are often too big to be used with many buttons and, therefore, require the use of specially designed buttons having large holes. Third, the fasteners tend to be conspicuous in appearance due to the fact that a separate fastener is used for every button hole, as opposed to being looped between two or more button holes in the same way that thread typically is.

SUMMARY OF THE INVENTION

It is an object of the present invention to provide a new and novel fastener clip including one or more fasteners particularly well-suited for attaching a button or the like to a garment or similar material.

It is another object of the present invention to provide a fastener clip as described above whose fasteners are less irritating than existing like fasteners when used in such a way that they are placed in direct contact with a person's skin.

It is still another object of the present invention to provide a fastener clip as described above whose fasteners are sized for use with conventional buttons.

It is still yet another object of the present invention to provide a fastener clip as described above whose fasteners, when used to attach buttons to a garment or the like, can achieve a look similar to that achieved with thread.

It is a further object of the present invention to provide a fastener clip as described above whose fasteners are designed for maximum strength while still permitting installation through very small holes such as are found in fine garments.

It is still a further object of the present invention to provide a fastener clip as described above which can be mass produced and which is capable of including a plurality of fasteners.

Additional objects, features, and advantages of the present invention will be set forth in part in the description which follows, and in part will be obvious from the description or may be learned by practice of the invention. The objects, features and advantages of the invention may be realized and attained by means of the instrumentalities and combinations particularly pointed out in the appended claims.

In a preferred embodiment of the invention, the fastener clip is a molded plastic structure defining a pair of runner bars and at least one fastener, the fastener comprising a U-shaped filament having a foot at each end, each foot being sized and shaped both to fit through a button hole and, once inserted through the button hole and an underlying garment, to securely engage the underside of the garment. Because of its loop design, the fastener is permitted to extend between adjacent button holes, thereby creating the illusion of thread.

To minimize contact with a person's skin, the feet of the present fastener are preferably shorter than the transverse bars of existing button fasteners and are preferably comparable in overall size to a knot of thread used to secure a button to a sheet of clothing material. In addition, the feet preferably have rounded ends and a flat top surface to minimize irritation of and contact with a person's skin. The filament portion of the fastener is preferably rectangular in cross-section and has a non-uniform thickness, i.e., being thinner at the ends and thicker in the arcuate region, to maximize the strength of the fastener.

The fastener is preferably connected to the pair of runner bars by a pair of severable connector posts, each connector post extending between the side of one of the feet and a corresponding runner bar so that, when the connector post is severed, a burr is not left on the underside of the feet where it may irritate a person's skin.

The outer edges of the runner bars are preferably provided with indentations which, as will be discussed below, are used to properly feed the fastener clip into a fastener attaching tool.

BRIEF DESCRIPTION OF THE DRAWINGS

The accompanying drawings, which are hereby incorporated in and constitute a part of this specification, illustrate the preferred embodiments of the invention and, together with the description, serve to explain the principles of the invention. In the drawings, wherein like reference numerals represent like parts.

DETAILED DESCRIPTION OF PREFERRED EMBODIMENTS

Figure 1:
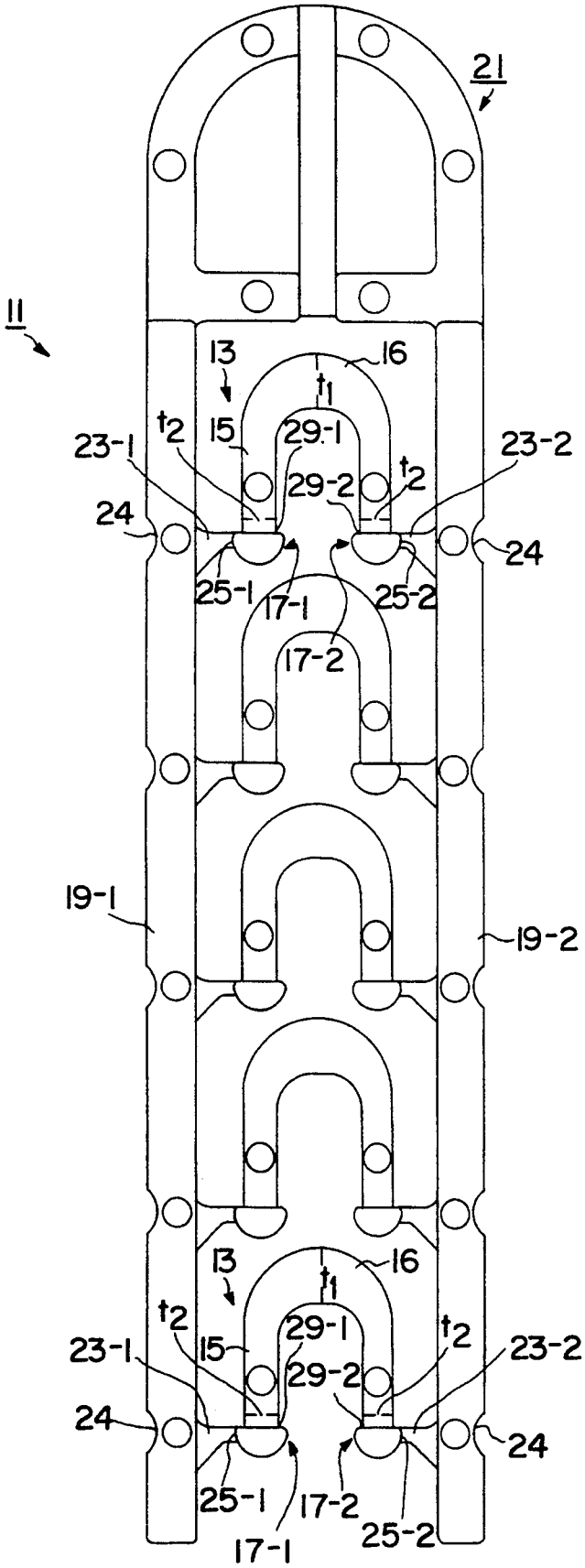
FIG. 1 is a front view of one embodiment of a fastener clip constructed according to the teachings of the present invention.
Figure 2:
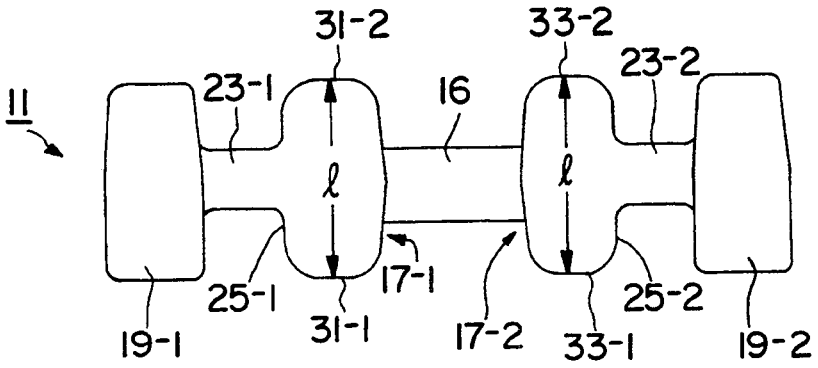
FIG. 2 is a bottom view of the fastener clip shown in FIG. 1.

Referring to the drawings and in particular to FIGS. 1 and 2, there are shown front and bottom view, respectively, of a fastener clip constructed according to the teachings of the present invention, the fastener clip being represented generally by reference numeral 11.

Clip 11 is a unitary structure preferably molded from polyurethane or similar materials. Clip 11 comprises five identical fasteners 13, the number of fasteners being illustrative only. Each fastener 13 includes a flexible U-shaped filament 15 and a pair of transverse bars or feet 17-1 and 17-2 disposed at opposite ends thereof. To maximize the strength of the fastener, filament 15 is preferably rectangular in cross-section and has a non-uniform thickness, i.e., the arcuate region 15 has a thickness $t_1$ greater than the thickness $t_2$ at the ends. Feet 17-1 and 17-2 are appropriately dimensioned so that they may be inserted into a desired garment through a pair of button holes of conventional size and thereafter be retained by the underside of the garment.

Clip 11 also comprises a pair of runner bars 19-1 and 19-2, the top ends of which are joined to form a handle 21. The outer edges of runner bars 19-1 and 19-2 are provided with indentations 24 which, as will be seen below, assist in properly feeding clip 11 into a fastener attaching tool.

Each fastener 13 is connected to runner bars 19-1 and 19-2 by severable connector posts 23-1 and 23-2, respectively. For reasons to be discussed below, connector posts 23-1 and 23-2 are connected to the outer sides 25-1 and 25-2 of feet 17-1 and 17-2, respectively.

Figure 3:
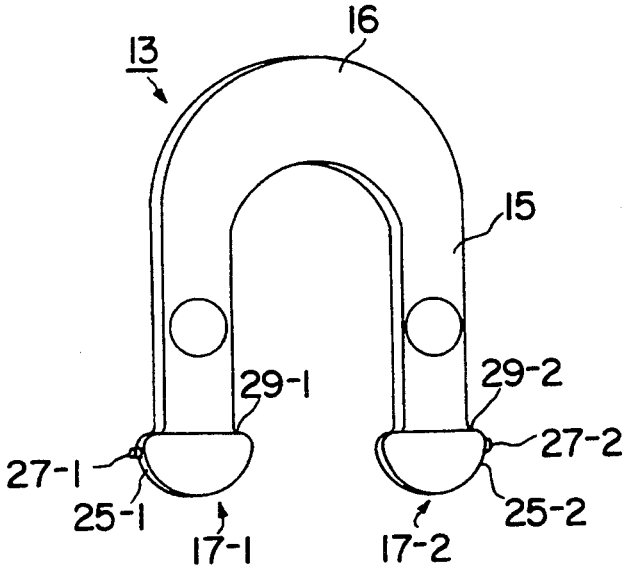
FIG. 3 is an enlarged front perspective view of one of the fasteners shown in FIG. 1 after it has been separated from the remainder of the fastener clip.

In order that fastener 13 may be used with garments in which feet 17-1 and 17-2 may be placed in direct contact with a person's skin, fastener clip 11 includes the following features which are designed to minimize irritation of a person's skin. First, as noted above, connector posts 23-1 and 23-2 are connected to the outer sides 25-1 and 25-2 of feet 17-1 and 17-2. In this manner, when posts 23-1 and 23-2 are severed, burrs 27-1 and 27-2 (see FIG. 3) are left on outer sides 25-1 and 25-2, where they are not as likely to come into contact with a person's skin as they would be if they were left on the bottom surface of feet 17-1 and 17-2. Second, feet 17-1 and 17-2 have a length 1 which is comparatively small, i.e., approximately 2 mm as compared to 6 mm for the transverse bars of existing like fasteners, and an overall size which is comparable to that of a knot of thread. Consequently, feet 17-1 and 17-2 have relatively little surface area which may come into contact with a person's skin. Third, the top surfaces 29-1 and 29-2 of feet 17-1 and 17-2, respectively, are generally flat. This gives feet 17-1 and 17-2 a low profile and inhibits the rotational movement of feet 17-1 and 17-2 relative to the underside of a garment to which fastener 13 has been attached (see FIG. 13). Fourth, feet 17-1 and 17-2 have rounded ends 31-1/31-2 and 33-1/33-2, respectively.

To use fastener 13 to couple a button to a garment, an individual fastener 13 is first detached from fastener clip 11 by severing connector posts 23-1 and 23-2. Feet 17-1 and 17-2 of the severed fastener 13 are then inserted first through a corresponding pair of button holes and then through the desired garment. Both the severing and inserting steps may be done manually or with the aid of an appropriate fastener attaching tool.

Figure 4:
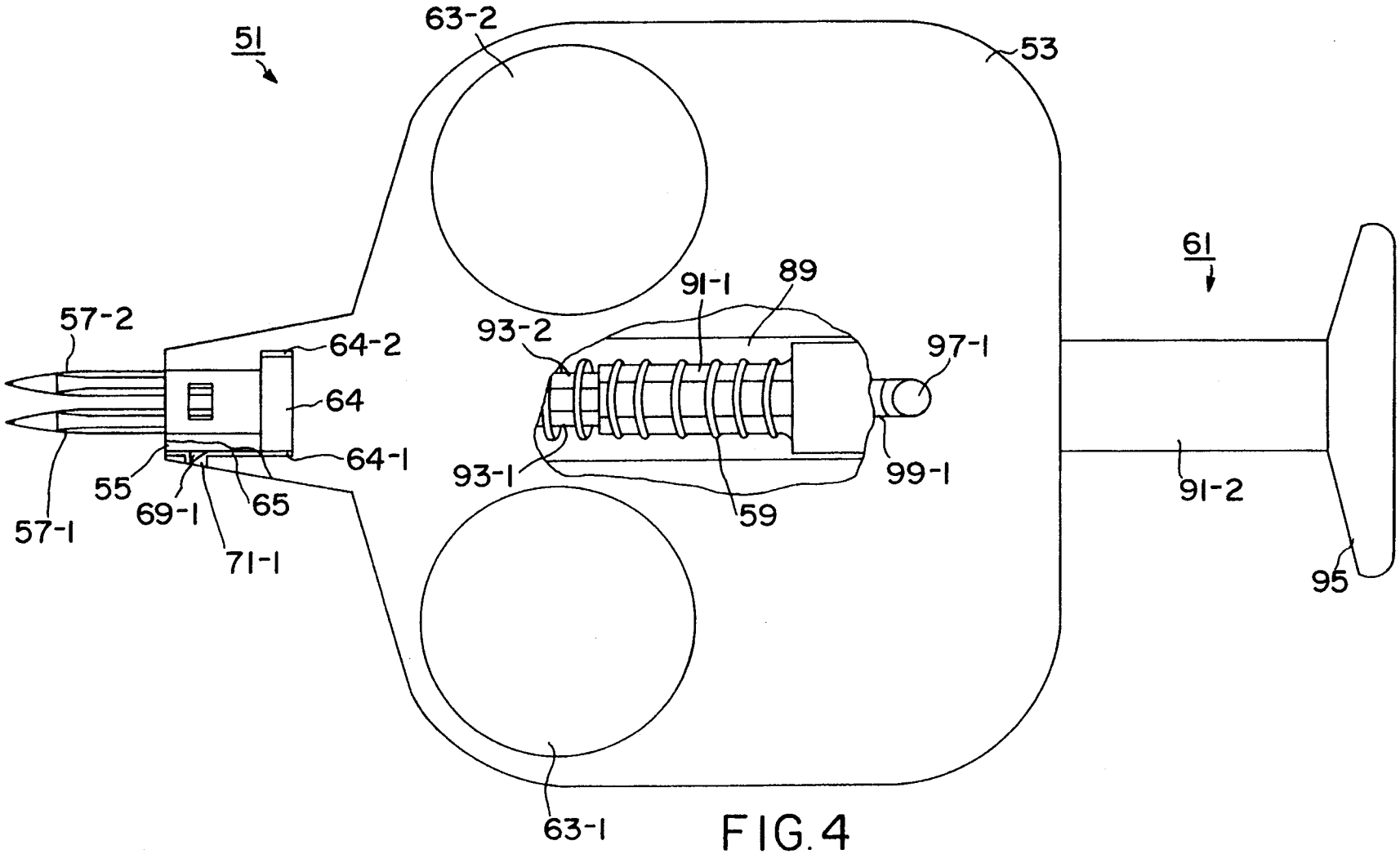
FIG. 4 is a top view of one embodiment of a fastener attaching device constructed according to the teachings of the present invention for attaching an individual fastener from the fastener clip of FIG. 1 to a garment through a pair of button holes in such a way as to attach the button to the garment.
Figure 5:
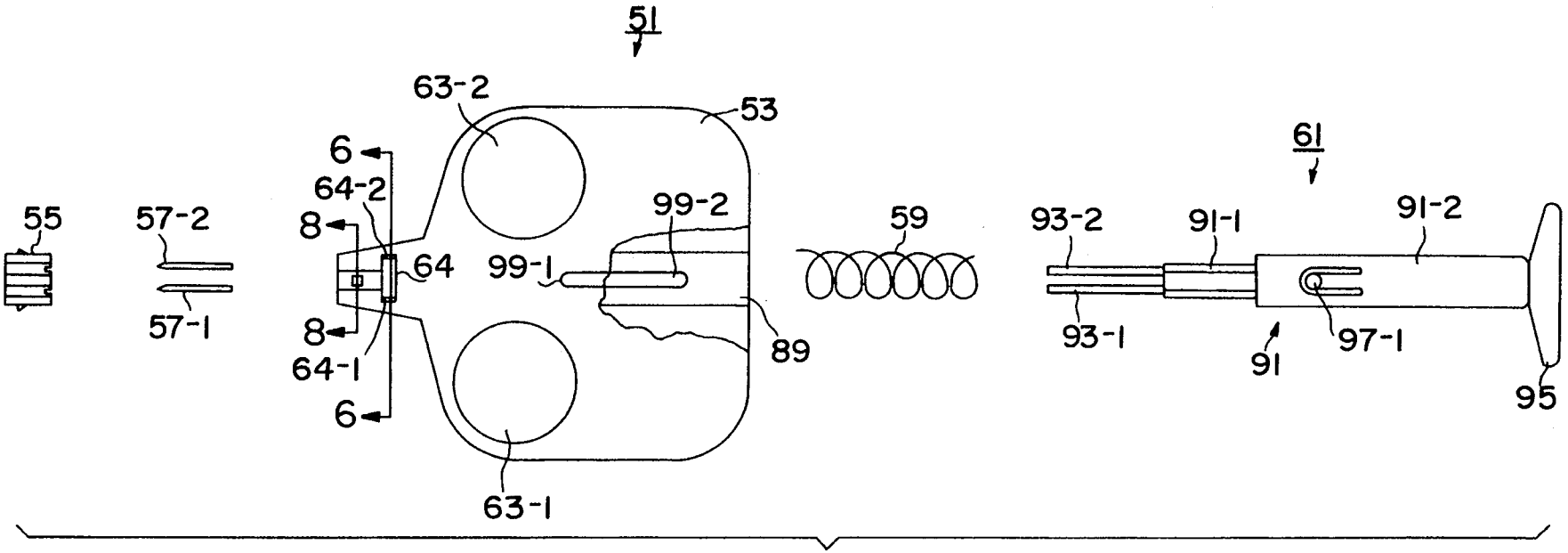
FIG. 5 is a partially exploded top view of the fastener attaching device shown in FIG. 4 with the body being broken away in part.

Referring now to FIGS. 4 and 5, there is shown one embodiment of a fastener attaching tool suitable for use with fastener clip 11 in the above-described manner, the fastener attaching tool being represented generally by reference numeral 51.

Tool 51 includes a body 53, a needle block 55, a pair of needles 57-1 and 57-2, a spring 59, and an ejector mechanism 61.

Figure 6:
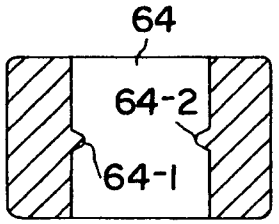
FIG. 6 is a section view of the body shown in FIG. 5 taken along line A—A.
Figure 7A:
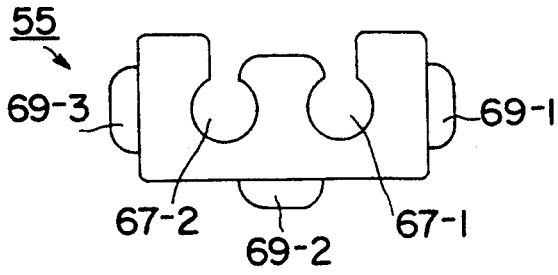
FIGS. 7(*a*) through 7(*d*) are front, rear, top and right side view, respectively, of the needle block shown in FIG. 5.
Figure 7B:
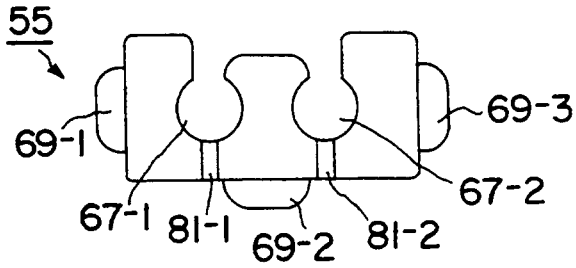
Figure 7C:
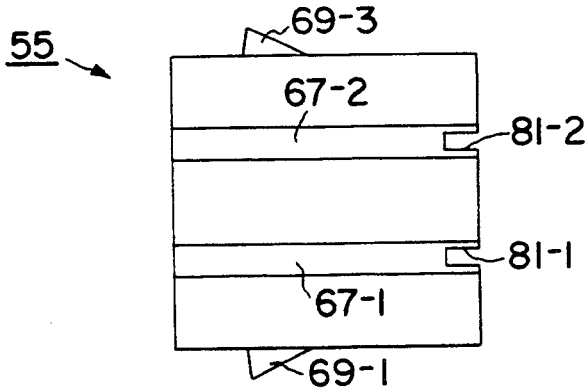
Figure 7D:
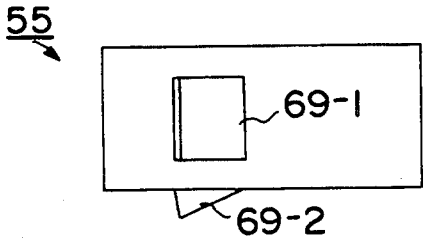

Body 53 is a unitary structure preferably molded from a lightweight durable plastic. Body 53 is shaped to define a pair of transverse openings 63-1 and 63-2 which are provided so that a user may operate tool 51 like a syringe by placing the index and middle fingers through openings 63-1 and 63-2 while actuating ejector mechanism 61 with the thumb. Body 53 is also provided with a transversely extending feed slot 64 down through which fastener clip 11 may be inserted in a direction perpendicular to the longitudinal axis of body 53. As can be seen best in FIG. 6, slot 64 is shaped to include a pair of feed bars 64-1 and 64-2 which, as will be discussed below in greater detail, are used to engage indentations 25 on runner bars 19-1 and 19-2, respectively, to properly align fastener clip 11 within tool 51.

Figure 8:
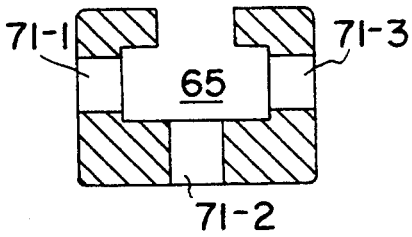
FIG. 8 is a section view of the body shown in FIG. 5 taken along line 8—8.
Figure 9A:
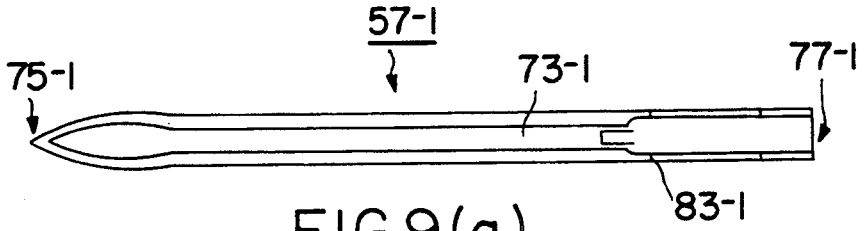
FIGS. 9(*a*) through 9(*d*) are top, right side, left side and rear views, respectively, of one of the needles shown in FIG. 5.
Figure 9B:
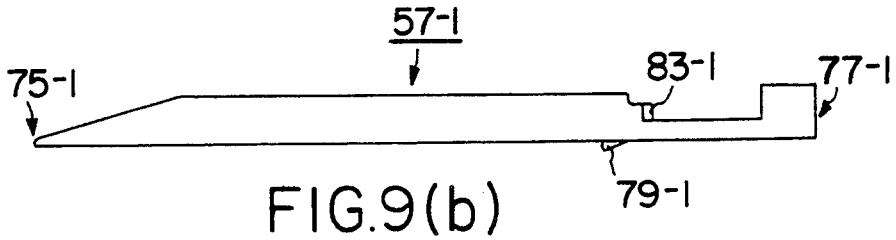
Figure 9C:
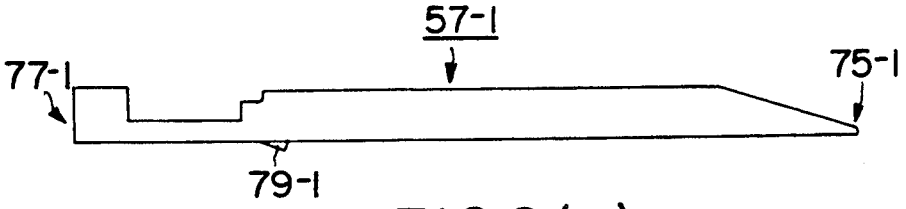
Figure 9D:
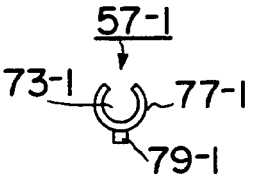

Needle block 55, which is removably mounted in a cavity 65 formed in body 53 and accessible from the front end thereof, is shown in greater detail in FIGS. 7(*a*) through 7(*d*). As can be seen therein, block 55 is a generally rectangular unitary structure having a pair of generally cylindrically shaped grooves 67-1 and 67-2 adapted to receive needles 57-1 and 57-2, respectively. Block 55 is retained within opening 65 by means of a plurality of outwardly biasing tabs 69-1 through 69-3 which snap into place in corresponding slots 71-1 through 71-3 (see FIG. 8) in cavity 65.

Block 55 is also preferably molded from a lightweight durable plastic.

Needle 57-1, which is a mirror image of needle 57-2 reflected along its longitudinal axis, is shown in greater detail in FIGS. 9(*a*) through 9(*d*). Also can be seen therein, needle 57-1 is a unitary structure shaped to include a generally cylindrical slotted bore 73-1. Bore 73-1 has a cross-sectional diameter slightly larger than that of foot 17-1 of fastener 13. The forward end 75-1 of needle 57-1 is pointed to permit its insertion through garments and button holes of conventional size. The rearward end 77-1 of needle 57-1 is open and is appropriately dimensioned to permit foot 17-1 to be loaded into bore 73-1 with the adjacent end of filament 15 extending through the slot of bore 73-1. Needle 57-1 is retained within groove 67-1 of block 55 by means of a downwardly-angled fin 79-1 which engages a corresponding slot 81-1 in groove 67-1 (see FIGS. 7(*b*) and 7(*c*)).

The left side of needle 57-1 (viewing needle 57-1 from its rearward end 77-1 as opposed to its forward end 79-1) is shaped to define a knife 83-1. As will be described below in greater detail, knife 83-1 is used to sever the connecting post 23-1 connecting a desired fastener 13 to runner bar 19-1. (A corresponding knife edge formed on the right side of needle 57-2 is similarly used to sever the connecting post 23-2 connecting the same fastener to runner bar 19-2.)

Needles 57-1 and 57-2 are preferably cut and stamped from sheet metal.

Figure 10A:
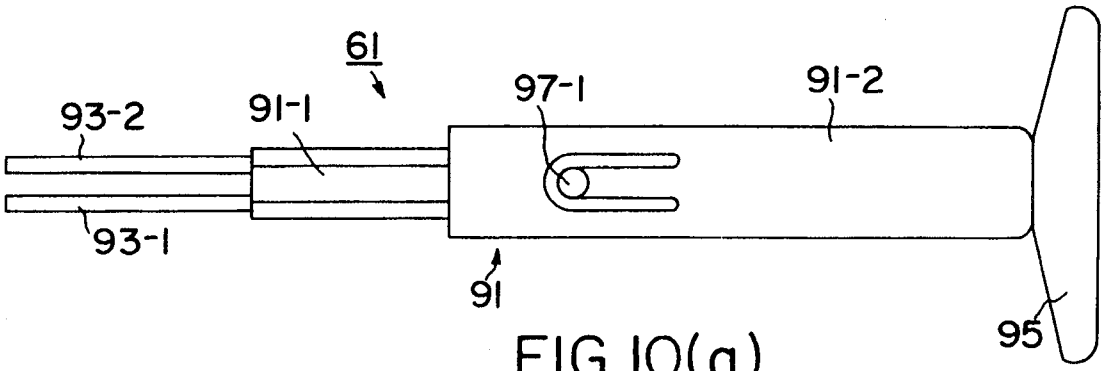
FIGS. 10(*a*) and 10(*b*) are bottom and right side views, respectively, of the ejector mechanism shown in FIG. 5.
Figure 10B:
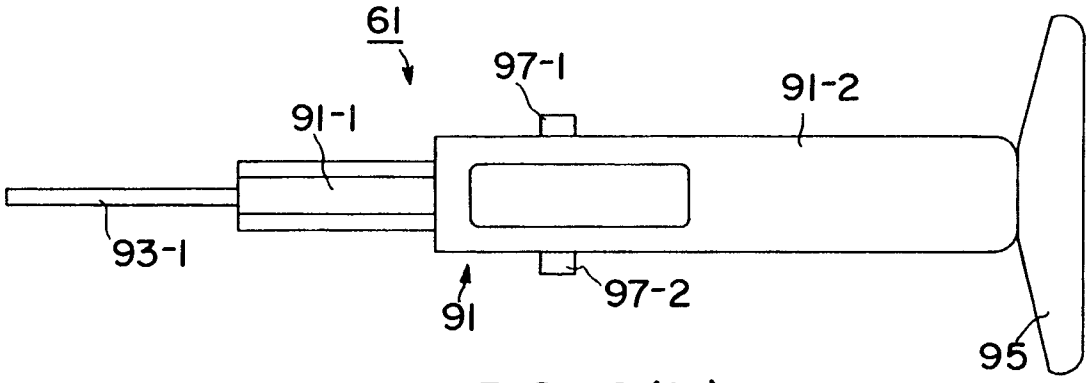

Ejector mechanism 61, which is shown in greater detail in FIGS. 10(*a*) and 10(*b*), is slidably mounted within a longitudinally extending channel 89 formed in body 53 and accessible from the rear end thereof. As can be seen therein, mechanism 61 comprises an elongated generally rectangular ejector block 91 having a front portion 91-1 of comparatively smaller cross-section and a rear portion 91-2 of comparatively larger cross-section. A pair of ejector rods 93-1 and 93-2 are fixedly mounted on the forward end of front portion 91-1. As will hereinafter be described in greater detail, ejector rods 93-1 and 93-2 are appropriately dimensioned and properly positioned so that, as ejector block 91 moves through channel 89, the front ends of ejector rods 93-1 and 93-2 cause feet 17-1 and 17-2 of a fastener 13 which is properly disposed within slot 64 to be loaded onto needles 57-1 and 57-2 and thereafter to be ejected therefrom. A disc-shaped base 95 is fixedly mounted on the rearward end of rear portion 91-2 to facilitate manipulation of mechanism 61.

Ejector rods 93-1 and 93-2 are preferably made of metal, and the remainder of ejector mechanism 61 is preferably molded from lightweight durable plastic.

Longitudinal movement of mechanism 61 within channel 89 is restricted by base 95 and by a pair of integrally formed posts 97-1 and 97-2 disposed on the top and bottom surfaces, respectively, of rear portion 91-2 which travel in corresponding guide slots 99-1 and 99-2 (see FIG. 5) formed in body 53. Posts 97-1 and 97-2 are made to be depressable inwardly to permit insertion of block 91 into channel 89. Spring 59, which engages the front of channel 89 at one end and the forward and of rear portion 91-2 at the opposite end, biases ejector mechanism 61 towards the rear of channel 89.

Figure 11:
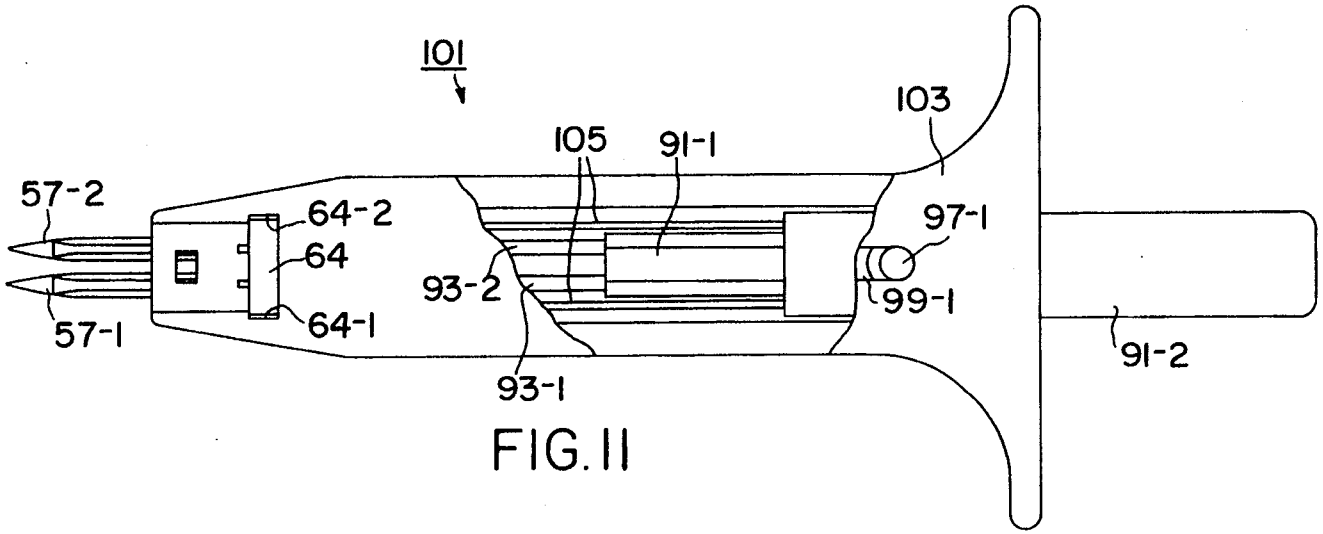
FIG. 11 is a top view, broken away in part, of a second embodiment of a fastener attaching device constructed according to the teachings of the present invention for attaching an individual fastener from the fastener clip of FIG. 1 to a garment through a pair of button holes in such a way as to attach the button to the garment.

A fastener dispensing tool similar in construction to tool 51 is shown in FIG. 11, the tool being represented generally by reference numeral 101. The differences between tool 101 and tool 51 are few, the principal differences being the shape of body 103, the lack of a base 95 in tool 101, and the construction of spring 105. Tool 101 is operated in the same way as tool 51.

In use, a desired fastener clip 11 is loaded into tool 51 by grasping handle 21 and pushing the clip down through slot 64 until the indentations 24 on runner bars 19-1 and 19-2 corresponding to a desired fastener 13 are engaged by bars 64-1 and 64-2. With this done, feet 17-1 and 17-2 of the desired fastener 13 are positioned behind needles 57-1 and 57-2, respectively, and are in alignment with their corresponding bores 73-1 and 73-2.

To attach a button to a piece of fabric using the fastener loaded in the above manner, the tips 75-1 and 75-2 of needles 57-1 and 57-2, respectively, are inserted first through a pair of holes in the button and then through the piece of fabric. Ejector mechanism 61 is then advanced through channel 89 towards the front of body 53. The initial advancement of ejector mechanism 61 causes ejector rods 93-1 and 93-2 to push feet 17-1 and 17-2 of the desired fastener 13 into bores 73-1 and 73-2. As the advancement of ejector mechanism 61 continues, ejector rods 93-2 and 93-2, push feet 17-1 and 17-2 past knife edges 83-1 and 83-2 of needles 57-1 and 57-2, causing connector posts 23-1 and 23-2 to be severed thereby. Finally, as the advancement of ejector mechanism 61 terminates, ejector rods 93-1 and 93-2 cause feet 17-1 and 17-2 to be ejected from the front ends of needles 57-1 and 57-2. Ejector mechanism 61 is then allowed to retract and needles 57-1 and 57-2 are withdrawn.

Figure 12:
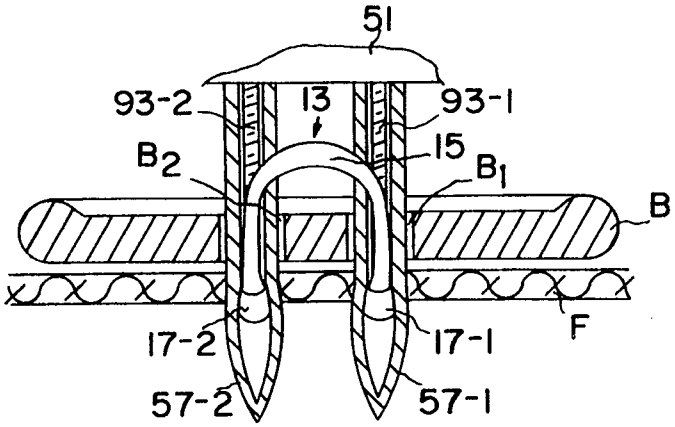
FIG. 12 is an enlarged section view of the front end of the fastener attaching device of FIG. 4 shown with the pair of ejector rods in an advanced position to illustrate how one of the fasteners shown in FIG. 1 may be inserted through a pair of button holes and secured to a garment.

FIG. 12 shows a fastener 13 being inserted through a pair of button holes $B_1$ and $B_2$ and into a piece of fabric F using tool 51.

Figure 13:
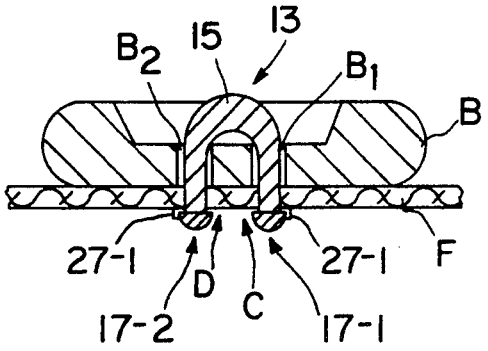
FIG. 13 is an enlarged section view similar to FIG. 12 but after the fastener attaching device has been removed showing how one of the fasteners shown in FIG. 1 is used to attach a button to a garment.
Figure 14:
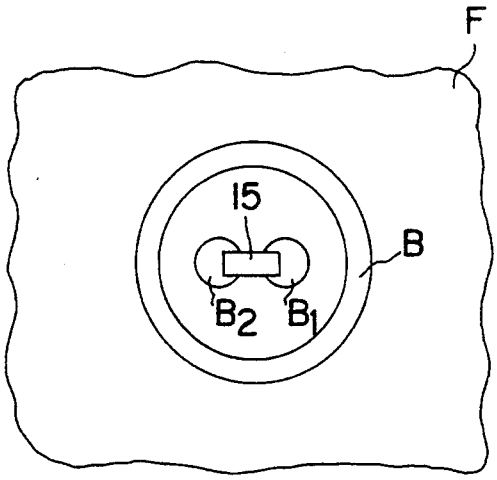
FIG. 14 is a top view of the combination of the button, garment and fastener shown in FIG. 13.

Referring now to FIGS. 13 and 14, there are shown section and top views, respectively, of a button B which has been coupled to a piece of fabric F using fastener 13. As seen best in FIG. 13, the advantages resulting from gating fastener 13 to runner bars 19-1 and 19-2 on the outer sides of feet 17-1 and 17-2 are substantial as burrs 27-1 and 27-2 are not left on the bottoms of feet 17-1 and 17-2 where they are most likely to irritate a person's skin. The consequences of making the top surfaces of feet 17-1 and 17-2 flat, as opposed to curved, to give feet 17-1 and 17-2 a low profile as well as to keep feet 17-1 and 17-2 from rocking in the directions indicated by arrows C and D can also be seen in FIG. 13. As seen best in FIG. 14, another benefit to fastener 13 is that, by having filament 15 extend between button holes $B_1$ and $B_2$ in a looped fashion, it creates the appearance that thread, as opposed to a plastic fastener, is being used to secure the button to the fabric.

Figure 16:
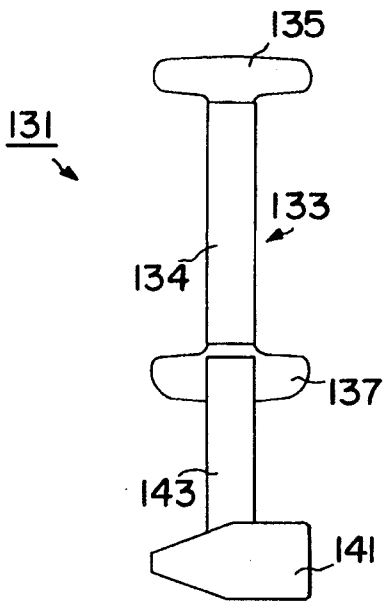
FIG. 16 is a left side view of the fastener clip shown in FIG. 15.
Figure 15:
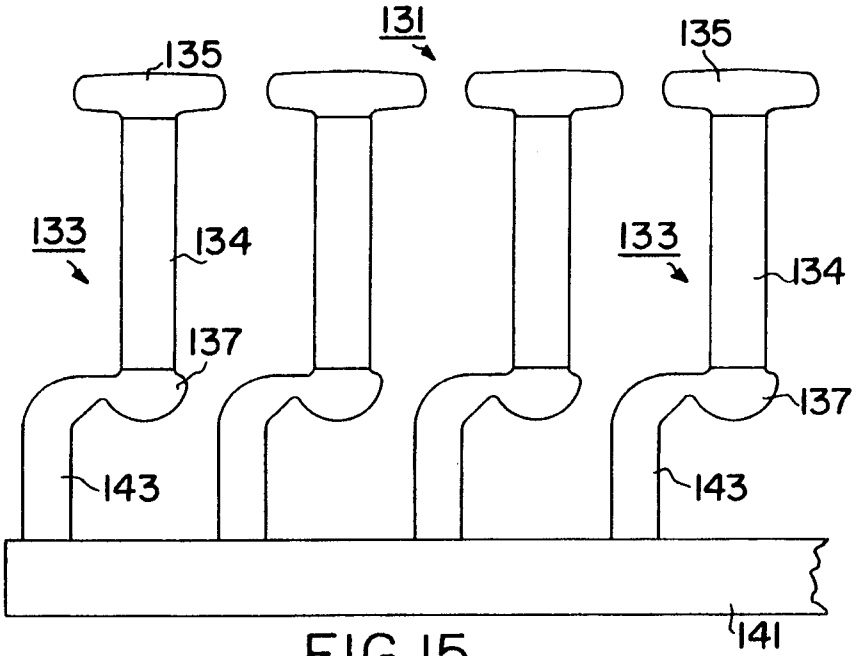
FIG. 15 is a fragmentary front view of a second embodiment of a fastener clip constucted according to the teachings of the present invention.
Figure 17:
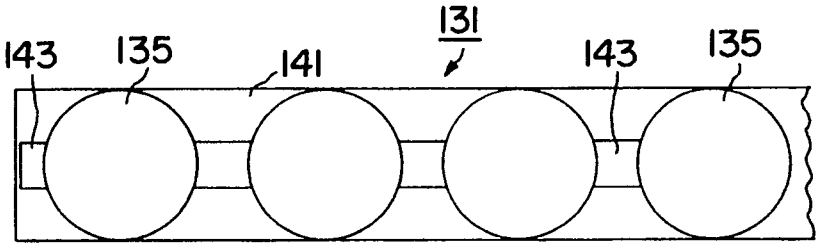
FIG. 17 is a top view of the fastener clip shown in FIG. 15.

Referring now to FIGS. 15 through 17, there are shown various views of a second embodiment of a fastener clip constructed according to the teachings of the present invention, the fastener clip being represented generally by reference numeral 131.

Fastener clip 131 includes a plurality of identical fasteners 133, each fastener 133 including a flexible filament 134 having a head 135 at one end and a foot 137 at the opposite end. Foot 137 is similar in size and shape to feet 17-1 and 17-2 of fastener 13. Fastener clip 131 also includes a runner bar 141 which is severably connected to fasteners 133 by connector posts 143, each connector post 143 being connected to the side of its corresponding foot 137.

The embodiment of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A fastener for attaching button to a piece of fabric, the button having two or more holes, said fastener comprising a flexible filament U-shaped prior to use in connection with attaching said button to said piece of fabric, a first transverse bar at one end of said flexible U-shaped filament and perpendicular thereto, and a second transverse bar at the opposite end of said flexible U-shaped filament and perpendicular thereto, said flexible U-shaped filament and said pair of transverse bars being appropriately dimensioned so that said pair of transverse bars may be inserted through a corresponding pair of holes in the button and then through the piece of fabric in such a way as to be retained by the underside of the piece of fabric, with said U-shaped filament looping between the pair of holes.

2. The fastener as claimed in claim 1 wherein said flexible U-shaped filament and said pair of transverse bars are integrally formed as a molded plastic structure.

3. The fastener as claimed in claim 1 wherein said fastener is made of plastic and wherein said flexible U-shaped filament is rectangular in cross-section and has a greater thickness in its arcuate region than at its end to provide for increased strength in its arcuate region.

4. The fastener as claimed in claim 1 wherein each of said first and said second transverse bar has a flat top surface.

5. The fastener as claimed in claim 1 wherein each of said first and said second transverse bar has rounded ends.

6. The fastener as claimed in claim 1 wherein each of said feet has an overall size comparable to a knot of thread used to secure a button to a piece of fabric.

7. A fastener clip adapted to be fed into a fastener attaching tool, said fastener clip comprising:

a) a fastener, said fastener comprising a flexible filament and a first transverse bar at one end of said flexible filament and perpendicular thereto, wherein said first transverse bar has a side and a bottom;

b) a first runner bar spaced from said fastener; and c) a first connector post projecting out transversely from said first runner bar and having a first end and a second end, said first connector post being connected at said first end to said first runner bar and severably connected at said second end to the side of said first transverse bar of said fastener, said second end of said first connector post not being connected to the bottom of said first transverse bar of said fastener so that, when severed from said first transverse bar, said second end of said first connector post does not leave a burr on the bottom of said first transverse bar.

8. A fastener adapted for attachment to a sheet of material, said fastener comprising a unitary plastic member shaped to define a flexible filament U-shaped prior to attachment to said sheet of material, a first traverse bar at one end of said flexible U-shaped filament, and a second traverse bar at the opposite end of said flexible U-shaped filament, said first and said second traverse bars extending generally parallel to one another, said flexible U-shaped filament and said pair of traverse bars being appropriately dimensioned so that said pair of transverse bars may be inserted through the sheet of material in such a way as to be retained by the underside of the sheet of material, with said U-shaped filament looping over the top of the sheet of material.

9. The fastener as claimed in claim 8 wherein said flexible U-shaped filament is rectangular in cross-section and has a greater thickness in its arcuate region than at its ends.

10. A fastener clip adapted to be fed into a fastener attaching tool, said fastener clip comprising a molded plastic structure shaped to define:

a) a plurality of fasteners, each fastener comprising a flexible U-shaped filament having a first transverse bar at one end and a second transverse bar at the other end, each transverse bar having an outer side and an inner side;

b) first and second parallel disposed runner bars, c) a plurality of first connector posts, each first connector post being connected at a first end to said first runner bar and severably connected at a second end to said outer side of said first transverse bar on one of said fasteners, and d) a plurality of second connector posts, each second connector post being connected at a first end to said second runner bar and severably connected at a second end to sid outer side of said second transverse bar on one of said fasteners.

11. A fastener clip adapted to be fed into a fastener attaching tool, said fastener clip comprising a molded plastic structure defining:

a) a plurality of fasteners, each fastener comprising a flexible U-shaped filament having a first transverse bar at one end and a second transverse bar at the other end, each transverse bar having an outer side and an inner side, and b) first and second parallel disposed runner bars, c) means for severably connecting the outer side of each first transverse bar to said first runner bar and the outer side of each second transverse bar to said second runner bar.

12. The fastener clip of claim 11 wherein each transverse bar has an outer side and wherein said transverse bars are connected to said runner bars at said outer sides.

13. A fastener clip comprising a unitary structure made of a flexible plastic material and shaped to define:

a) a pair of parallel disposed, spaced apart runner bars, and b) a plurality of fasteners disposed between said pair of parallel disposed, spaced apart runner bars, each fastener comprising a U-shaped filament having a transverse bar at each end, said transverse bar at one end being severably connected to said first runner bar and said transverse bar at said other end being severably connected to said other runner bar.

14. The fastener clip of claim 13 wherein said means comprises a plurality of connector posts.

15. A fastener clip adapted to be fed into a fastener attaching tool, said fastener clip comprising:

a) a fastener, said fastener comprising a flexible filament and a first transverse bar at one end of said flexible filament and perpendicular thereto, wherein said first transverse bar as a side;

b) a first runner bar spaced from said fastener; and c) a first connector post projecting out transversely from said first runner bar at right angles thereto and having a first end and a second end, said first connector post being connected at said first end to said first runner bar and severably connected at said second end to said side of said first transverse bar of said fastener, said second end of said first connector post not being connected to the bottom of said first transverse bar of said fastener so that, when severed from said first transverse bar, said second end of said first connector post does not leave a burr on the bottom of said first transverse bar.

16. The fastener clip as claimed in claim 15 wherein said flexible filament is U-shaped, said fastener further comprising a second transverse bar at the opposite end of said flexible filament.

17. The fastener clip as claimed in claim 16 further comprising a second runner bar and a second connector post, said second connector post being connected at a first end to said second runner bar and severably connected at a second end to the side of said second transverse bar.

18. The fastener clip as claimed in claim 17 wherein said first connector post and said second connector post are connected to the outer sides of said first transverse bar and said second transverse bar, respectively.

19. The fastener clip as claimed in claim 18 wherein at least one of said first runner bar and said second runner bar is provided with means for properly aligning said fastener within a fastener attaching tool.

20. The fastener clip as claimed in claim 19 wherein said aligning means comprises an indentation formed along the outer side of at least one of said first runner bar and said second runner bar.

* * * * *